US007447463B2

(12) United States Patent
Koido

(10) Patent No.: US 7,447,463 B2
(45) Date of Patent: Nov. 4, 2008

(54) DEVELOPING DEVICE AND IMAGE FORMING APPARATUS

(75) Inventor: Shigenori Koido, Tokyo (JP)

(73) Assignee: Oki Data Corporation, Tokyo (JP)

( * ) Notice: Subject to any disclaimer, the term of this patent is extended or adjusted under 35 U.S.C. 154(b) by 124 days.

(21) Appl. No.: 11/520,620

(22) Filed: Sep. 14, 2006

(65) Prior Publication Data

US 2007/0077084 A1 Apr. 5, 2007

(30) Foreign Application Priority Data

Sep. 30, 2005 (JP) ..... 2005-289081
Mar. 10, 2006 (JP) ..... 2006-066212

(51) Int. Cl.
*G03G 15/08* (2006.01)

(52) U.S. Cl. ..... 399/103; 399/105

(58) Field of Classification Search ..... 399/103, 399/105, 106, 102, 98, 111, 119, 120
See application file for complete search history.

(56) References Cited

U.S. PATENT DOCUMENTS 6,181,897 B1 * 1/2001 Kawai ..... 399/103
6,496,668 B2 * 12/2002 Sato et al. ..... 399/103
2002/0090226 A1 * 7/2002 Sato et al. ..... 399/103
2003/0118364 A1 * 6/2003 Kamimura ..... 399/103
2005/0180774 A1 * 8/2005 Ohgoshi et al. ..... 399/103
2005/0276627 A1 * 12/2005 Nozawa ..... 399/103

FOREIGN PATENT DOCUMENTS

JP 2002-108089 4/2002

* cited by examiner

*Primary Examiner*—Sophia S Chen
(74) *Attorney, Agent, or Firm*—Kubotera & Associates, LLC

(57) ABSTRACT

A developing device includes an image supporting member; a developer supporting member for attaching developer to a latent image formed on a surface of the image supporting member for developing; a supply member for supplying developer to the developer supporting member; a first sealing member arranged to contact with both ends of the developer supporting member and the supply member; a holding member for holding the first sealing member; a case for attaching the developer supporting member and the supply member; a second sealing member arranged in the case for contacting with a lower surface of the developer supporting member in a longitudinal direction thereof when the developer supporting member is attached to the case. Further, a restricting section is provided in the case for restricting a movement of the holding member when the developer supporting member is attached to the case.

18 Claims, 11 Drawing Sheets

DEVELOPING DEVICE AND IMAGE FORMING APPARATUS

BACKGROUND OF THE INVENTION

The present invention relates to a developing device and an image forming apparatus.

A conventional image forming apparatus of an electrophotography type such as a printer, a copier, a facsimile, and a multi-functional device includes a photosensitive drum (image supporting member); a charge unit having a charge roller for charging a surface of the photosensitive drum; an exposure device for exposing the surface of the photosensitive drum to form a static latent image or a latent image thereon; a developing roller for attaching toner to the static latent image on the photosensitive drum to form a toner image thereon; and a transfer unit for transferring the toner image to a recording medium; and a fixing unit for applying pressure and heat to toner transferred to the recording medium at the transfer unit for fixing, thereby recording or printing an image on the recording medium.

In a certain type of image forming apparatus, a developing device is integrally formed of a photosensitive drum, a charge unit, and a developing roller.

FIG. 2 is a perspective view of a major portion of the conventional developing device. FIG. 3 is an enlarged view of the major portion of the conventional developing device.

The developing device (image forming processing cartridge) is detachably attached to a main body of a printer and extends in a direction perpendicular to a direction of transporting a sheet (not shown). Four developing devices are disposed in a row along the sheet transporting direction, and compose image forming units of black, yellow, magenta, and cyan. Each of the developing devices comprises a main body of the developing device and a toner cartridge detachably attached to the main body of the developing device for holding toner in each color.

The developing device has a base frame 14 and an upper frame (not shown). The based frame 14 supports a photosensitive drum (image supporting member), a charging roller, a developing roller, a cleaning member, and so on. A film 23 is attached onto a bottom surface of the base frame 14, and a supply roller assembly 61 having a supply roller 18, a stir bar 26, and so on is attached to a side surface of the base frame 14.

The supply roller assembly 61 has sealing members 39L and 39R at both ends thereof for supporting the supply roller 18 and the stir bar 26, and sealing plates 28L and 28R for holding the sealing members 39L and 39R (only sealing plate 28R is shown in FIG. 2). Each of the sealing members 39L and 39R has a side sponge 29 arranged to contact with an end surface of the supply roller 18 and a felt sponge 30 arranged to contact with an outer circumferential surface of the developing roller at an end thereof. (For example, see Patent Reference)

Patent Reference: Japan Patent Publication No. 2002-108089

In the conventional image forming apparatus described above, it is difficult to seal the supply roller assembly 61 with a sufficient force. Accordingly, when the developing device is attached to a main body of an image forming apparatus, toner (not shown) may be leaked from the both ends of the supply roller assembly 61.

In view of the problem described above, an object of the invention is to provide a developing device and an image forming device, in which it is possible to solve the problems of the conventional printer and improve sealing.

Further objects of the invention will be apparent from the following description of the invention.

SUMMARY OF THE INVENTION

In order to attain the objects, according to the present invention, a developing device comprises an image supporting member; a developer supporting member for attaching developer to a latent image formed on a surface of the image supporting member for developing; a supply member for supplying developer to the developer supporting member; a first sealing member arranged to contact with both ends of the developer supporting member and the supply member; a holding member for holding the first sealing member; a case for attaching the developer supporting member and the supply member; a second sealing member arranged in the case for contacting with a lower surface of the developer supporting member in a longitudinal direction thereof when the developer supporting member is attached to the case.

Further, a restricting section is provided in the case for restricting a movement of the holding member when the developer supporting member is attached to the case.

DETAILED DESCRIPTION OF THE PREFERRED EMBODIMENTS

Hereunder, embodiments of the present invention will be described in more detail with reference to the accompanying drawings. In the description below, a color printer is described as an image forming apparatus.

First Embodiment

Figure 4:
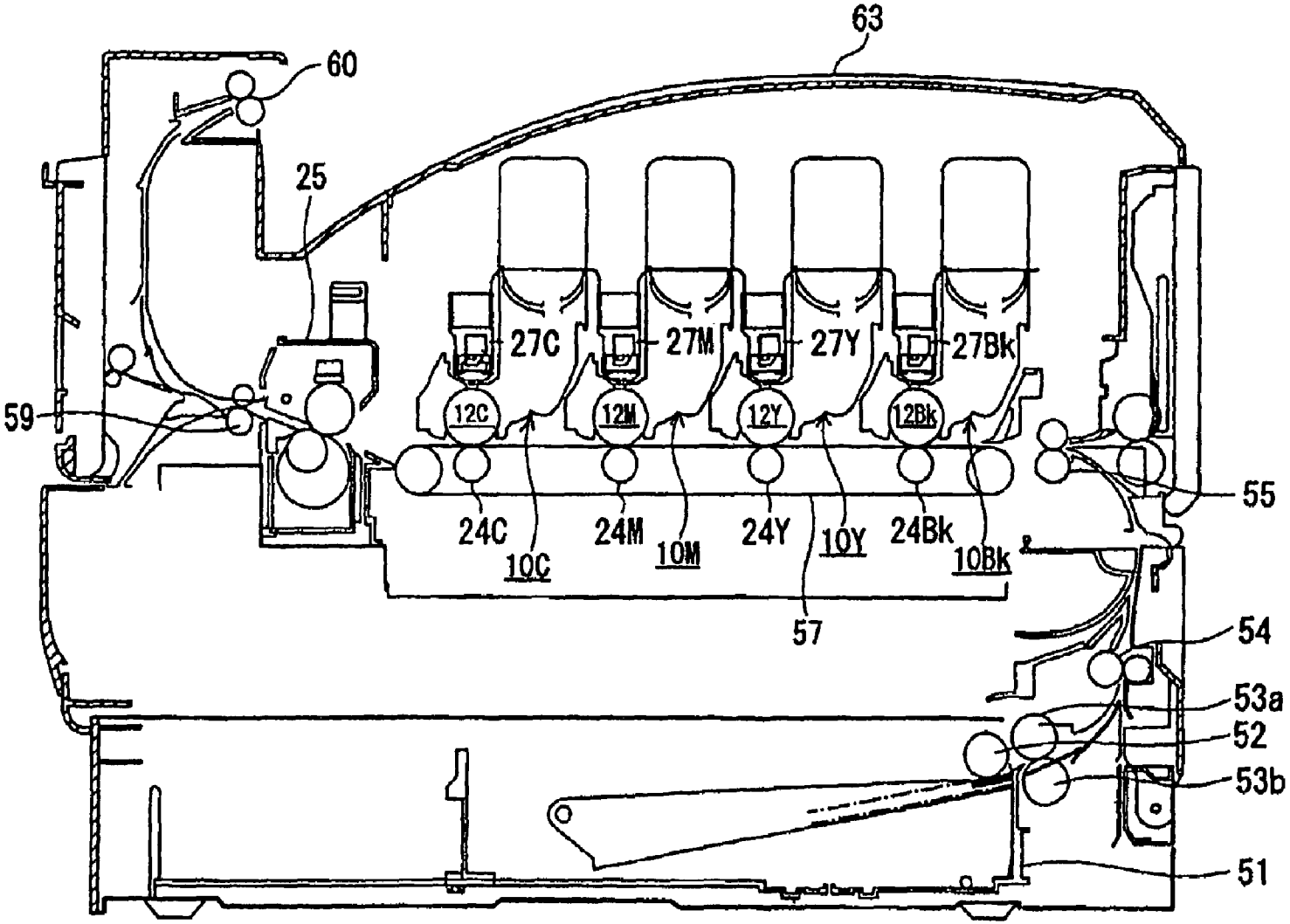
FIG. 4 is a schematic view of a printer according to the first embodiment of the present invention.

FIG. 4 is a schematic view of a color printer according to a first embodiment of the present invention. As shown in FIG. 4, a sheet cassette 51 is disposed at a lower part of a printer main body as a medium holder for holding a sheet or recording medium (not shown). A sheet feeding mechanism or medium feeder is disposed adjacent to a front edge of the sheet cassette 51 for feeding a sheet while separating the sheet one by one.

The sheet feeding mechanism has a separation roller 52 and sheet supply rollers 53*a* and 53*b*. The sheet feeding mechanism transports a sheet to conveyance roller units 54 and 55 arranged thereabove. A conveyance belt or conveyance member 57 is driven to convey the sheet to developing devices 10Bk, 10Y, 10M, and 10C, i.e., a plurality of image forming units. The sheet travels through between transfer rollers or transfer devices 24Bk, 24Y, 24M, and 24C and photosensitive drums or image supporting members 12Bk, 12Y, 12M, and 12C arranged in the respective developing devices 10Bk, 10Y, 10M, and 10C. The transfer rollers 24Bk, 24Y, 24M, and 24C successively transfer a toner image, which is an image developed successively in each color on the respective photosensitive drums 12Bk, 12Y, 12M, and 12C, onto the sheet, thereby forming a color toner image.

Thereafter, the sheet is sent to a fixing unit or fixing device 25 for fixing the color toner image on the sheet, thereby forming a color image. Then, the sheet ejected from the fixing unit 25 is conveyed with a conveyance roller 59. The sheet is ejected outside the printer main body by a ejecting conveyance roller 60, and loaded on an upper cover or medium loading unit 63.

In order to form a latent image by exposing the surfaces of the photosensitive drums 12Bk, 12Y, 12M, and 12C, LED heads 27Bk, 27Y, 27M, and 27C are respectively disposed as exposing devices so as to face the developing devices 10Bk, 10Y, 10M, and 10C.

The respective developing devices 10Bk, 10Y, 10M, and 10C are disposed so as to be freely attachable/detachable to/from the printer main body. The LED heads 27Bk, 27Y, 27M, and 27C are held with the upper cover 63.

The developing devices will be further described below. Since the developing devices 10Bk, 10CY, 10CM, and 10C have an identical configuration, only the developing device 10Bk will be described below, and the descriptions of the developing devices 16Y, 16M, 16C are omitted.

Figure 5:
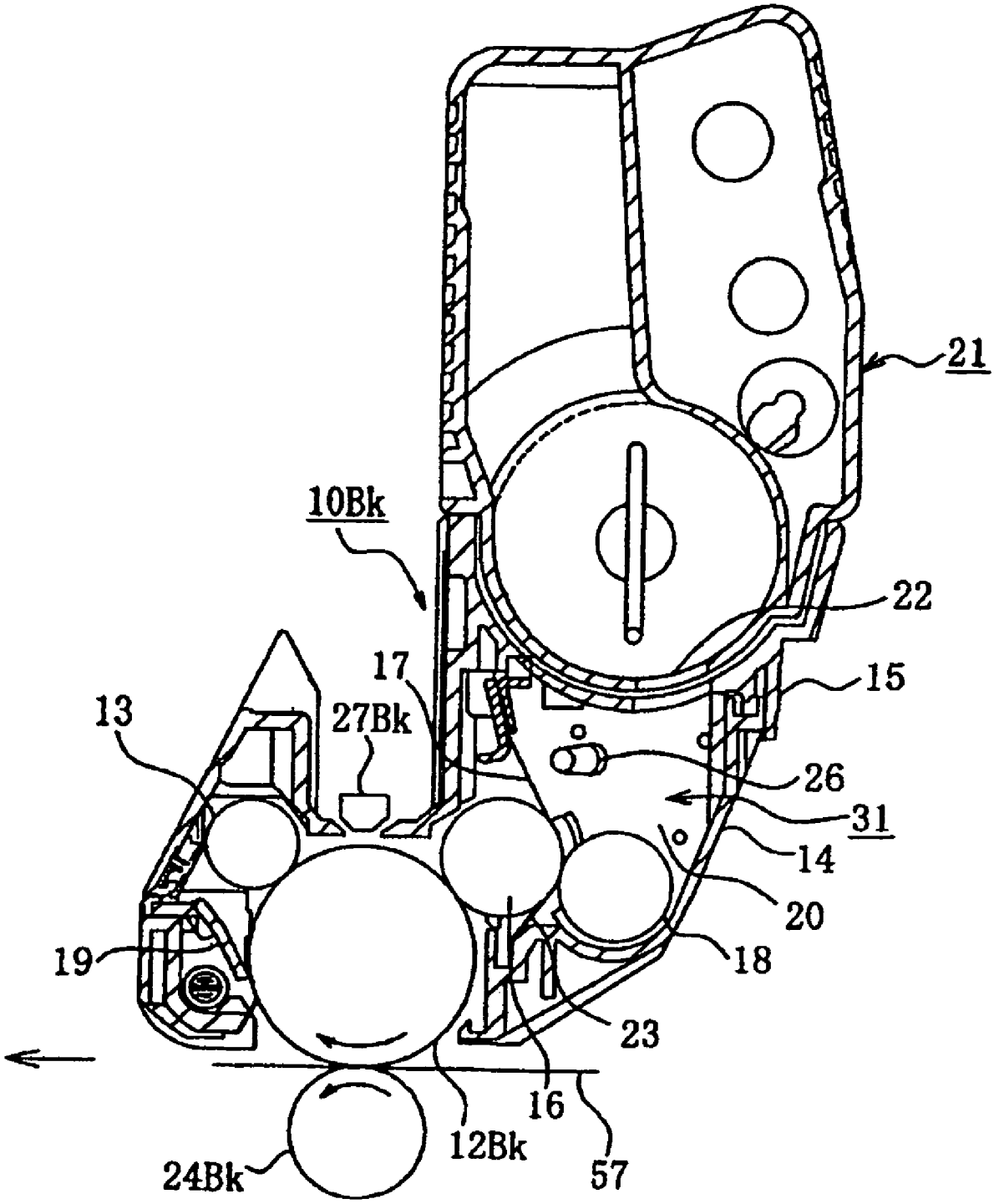
FIG. 5 is a cross-sectional view of the major portion of the developing device according to the first embodiment of the present invention.

FIG. 5 is a cross-sectional view of a major portion of the developing device according to the first embodiment of the present invention.

The developing device 10Bk comprises the photosensitive drum 12Bk; the charging roller or charging member 13 disposed to contact with the photosensitive drum 12Bk for uniformly charging the surface of the photosensitive drum 12Bk; the developing roller or developer supporting member 16 disposed to contact with the photosensitive drum 12Bk for holding toner or developer (not shown) and attaching toner onto the photosensitive drum 12Bk while rotating to develop a latent image thereon to form a toner image; the supply roller or supply member 18 disposed to contact with the developing roller 16 for feeding toner to the developing roller 16; a developing blade 17 disposed to contact with the developing roller 16 at an end thereof for obtaining a thin layer of toner fed on the developing roller 16; a cleaning unit (cleaning blade) or cleaning device 19 for removing toner remaining on the photosensitive drum 12Bk after transferring the toner image; and a stir bar 26 for stirring toner in a storage section 20.

The developing device 10Bk further comprises a film or strip-shaped sealing member 23 formed of a thermoplastic urethane and disposed to contact with the developing roller 16 and extend along a longitudinal direction thereof, so that toner in the storage section 20 does not leak to a side of the photosensitive drum 12Bk. A developing unit is formed mainly of the developing roller 16, the supply roller 18, and the developing blade 17.

The developing device 10Bk has the developing device main body and a toner cartridge or developer cartridge 21 disposed so as to be freely attachable/detachable to/from the developing device main body for holding toner. An opening 22 is formed in a bottom wall of the toner cartridge 21. In the developing device main body, the storage section 20 holds toner dropped from the toner cartridge 21 through the opening 22. The LED head 27Bk is disposed above the photosensitive drum 12Bk and outside the developing device 10Bk, while the transferring roller 24Bk is disposed below the photosensitive drum 12Bk.

The developing device main body comprises a base frame 14 as a first case and an upper frame 15 as a second case. The photosensitive drum 12Bk, the charging roller 13, the developing roller 16, the cleaning unit 19, and so on are supported with the base frame 14. The film 23 is attached on a bottom surface of the base frame via a double-sided tape, and contacts with a lower part of the developing roller 16. A supply roller assembly 31 comprising the supply roller 18 and the stir bar 26 is attached on a side surface of the base frame 14.

In the developing device 10Bk described above, an image forming unit driving motor or driving unit (not shown) drives the developing roller 16 and the supply roller 18 to rotate counterclockwise for feeding toner or developer upon printing, so that the supply roller 18 supplies toner to the developing roller 16. Then, toner fed to the developing roller 16 is sent to a contacting section between the developing roller 16 and the developing blade 17 as the developing roller 16 rotates. The developing blade 17 scrapes off excess toner, so toner becomes a thin layer and supplied to the photosensitive drum 12Bk.

The image forming unit driving motor drives the photosensitive drum 12Bk to rotate clockwise (in an arrow direction). While the photosensitive drum 12Bk rotates, the charging roller 13 uniformly charges the surface of the photosensitive drum 12Bk. The LED head 27Bk exposes the surface of the photosensitive drum 12Bk thus charged, so that a latent image is formed. Then, toner on the developing roller 16 sticks onto the latent image, thereby forming a toner image.

Figure 1:
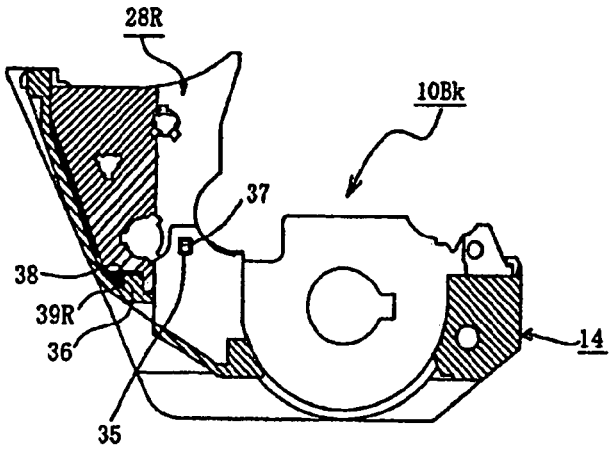
FIG. 1 is a side view of a major portion of a developing device according to a first embodiment of the present invention.
Figure 2:
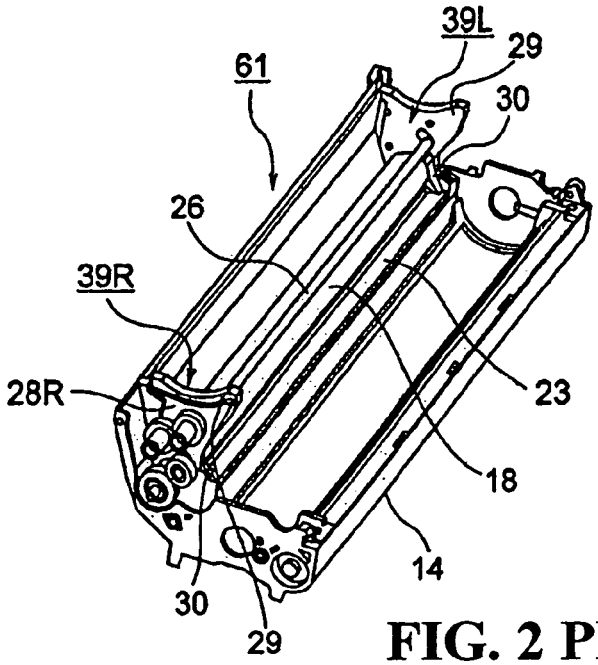
FIG. 2 PRIOR ART
FIG. 2 is a perspective view of a major portion of a conventional developing device.
Figure 3:
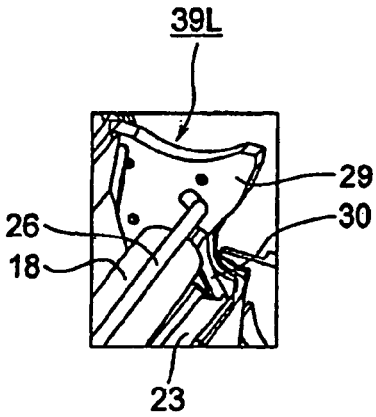
FIG. 3 PRIOR ART
FIG. 3 is an enlarge view of the major portion of the conventional developing device.

A process of assembling the developing device will be described next. FIG. 1 is a side view of the major portion of a developing device according to a first embodiment of the present invention.

Figure 6:
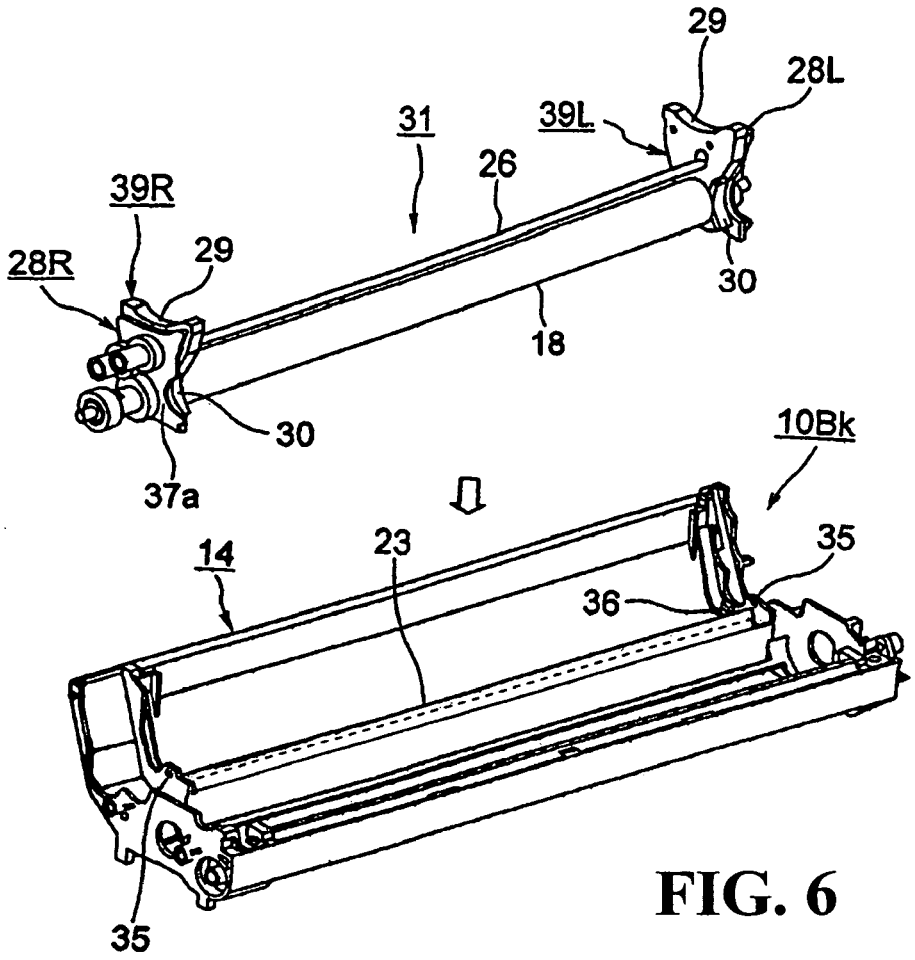
FIG. 6 is a perspective view (No. 1) showing a process of assembling the developing device according to the first embodiment of the present invention.
Figure 7:
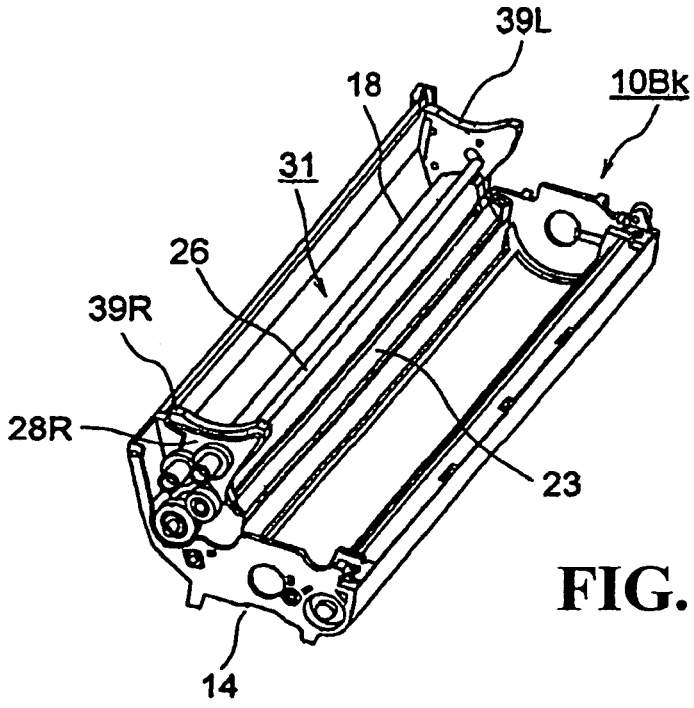
FIG. 7 is a perspective view (No. 2) showing the process of assembling the developing device according to the first embodiment of the present invention.
Figure 8:
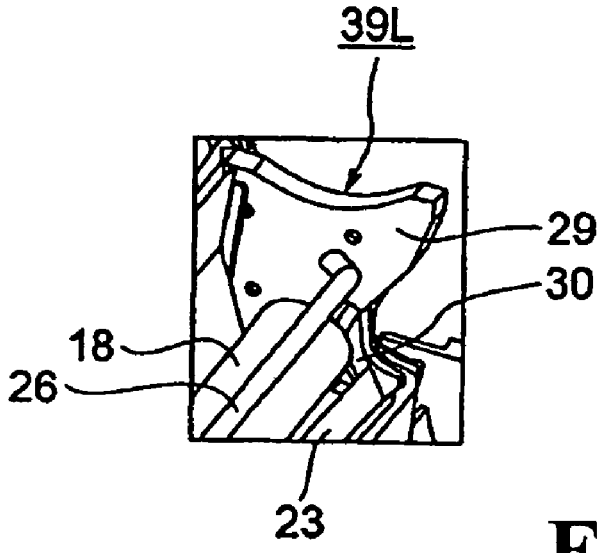
FIG. 8 is an enlarged view of the major portion of the developing device according to the first embodiment of the present invention.
Figure 9:
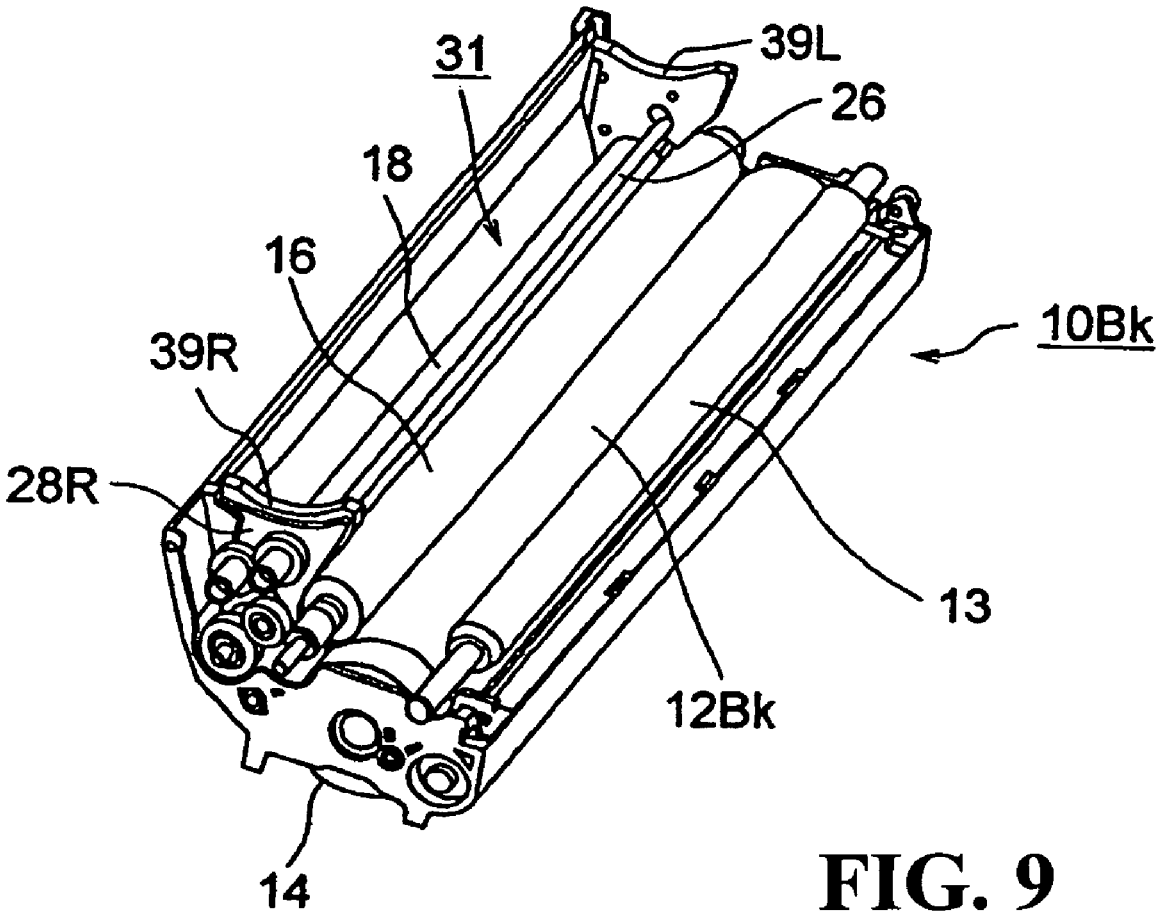
FIG. 9 is a perspective view (No. 3) showing the process of assembling the developing device according to the first embodiment of the present invention.
Figure 10:
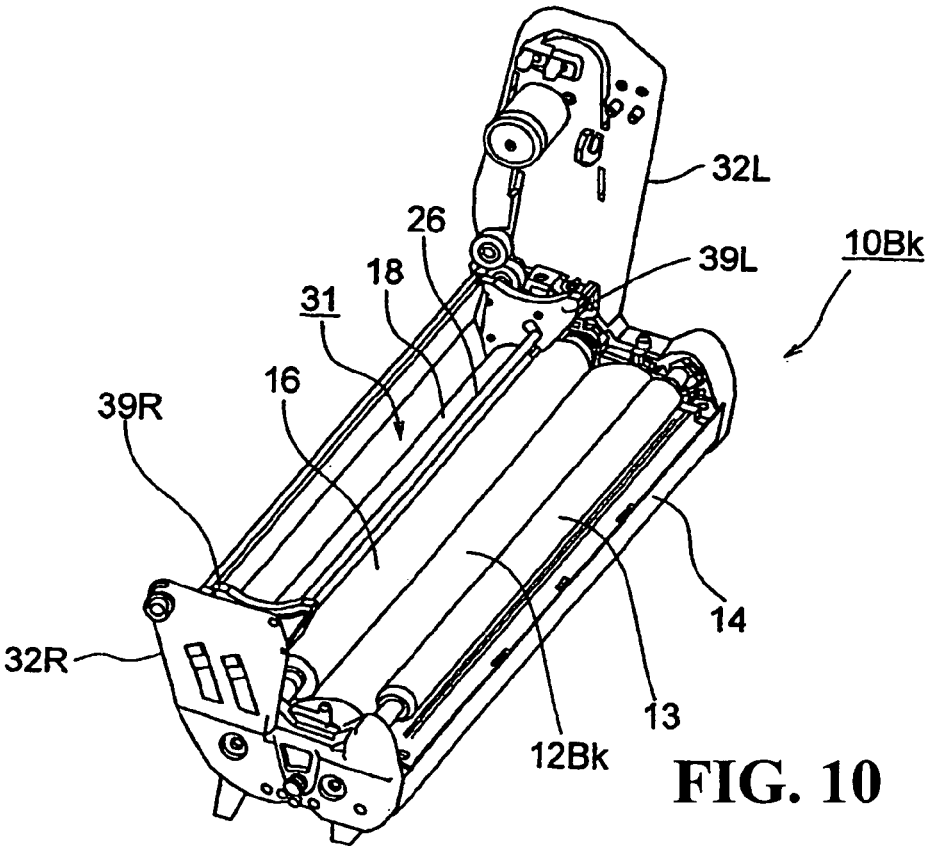
FIG. 10 is a perspective view (No. 4) showing the process of assembling the developing device according to the first embodiment of the present invention.
Figure 11:
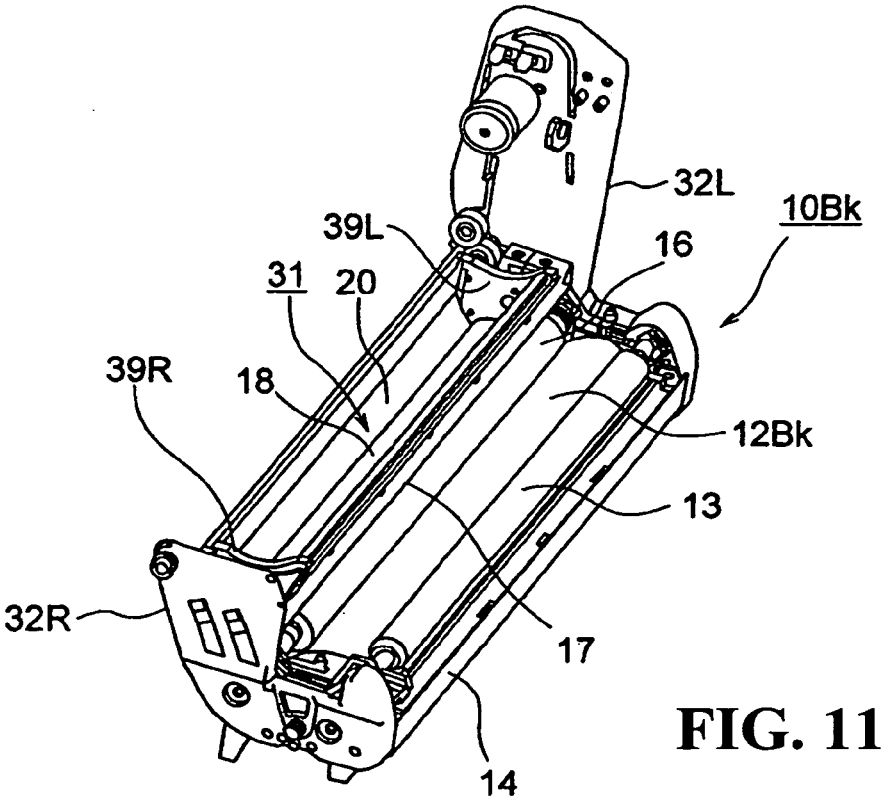
FIG. 11 is a perspective view (No. 5) showing the process of assembling the developing device according to the first embodiment of the present invention.
Figure 12:
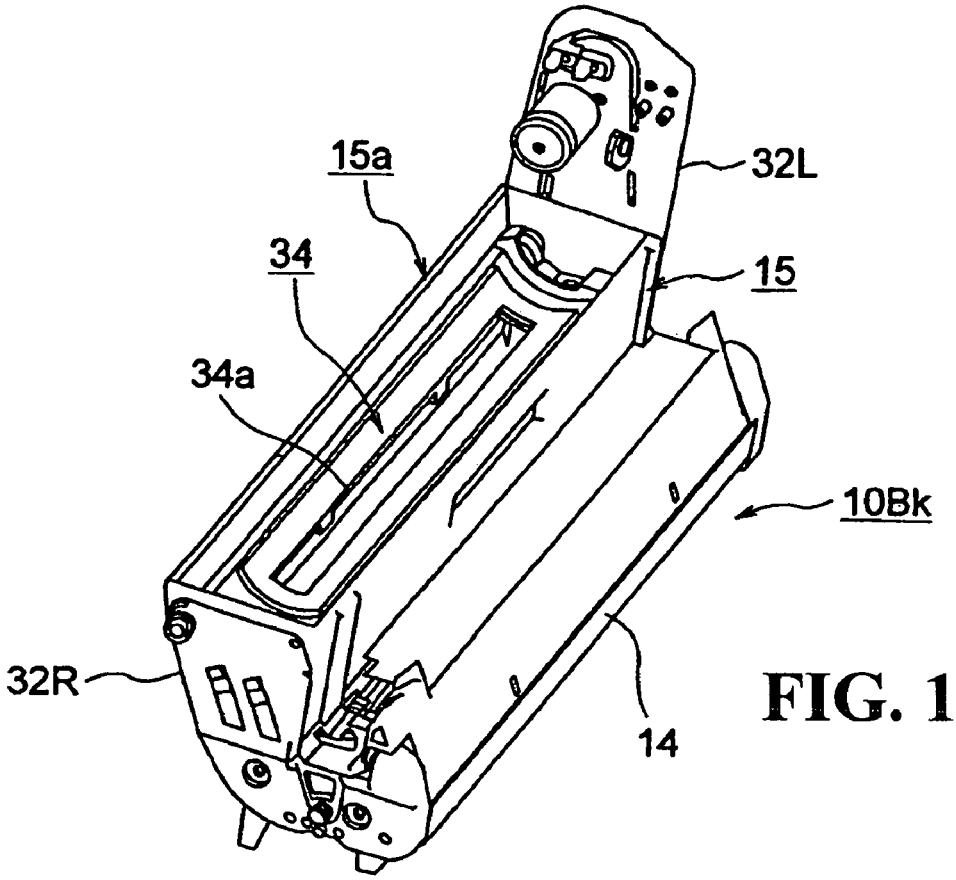
FIG. 12 is a perspective view (No. 6) showing the process of assembling the developing device according to the first embodiment of the present invention.

Further, FIG. 6 is a perspective view (No. 1) showing a process of assembling the developing device according to the first embodiment of the present invention. FIG. 7 is a perspective view (No. 2) showing the process of assembling the developing device according to the first embodiment of the present invention. FIG. 8 is an enlarged view of the major portion of the developing device according to the first embodiment of the present invention. FIG. 9 is a perspective view (No. 3) showing the process of assembling the developing device according to the first embodiment of the present invention. FIG. 10 is a perspective view (No. 4) showing the process of assembling the developing device according to the first embodiment of the present invention. FIG. 11 is a perspective view (No. 5) showing the process of assembling the developing device according to the first embodiment of the present invention. FIG. 12 is a perspective view (No. 6) showing the process of assembling the developing device according to the first embodiment of the present invention.

Figure 13:
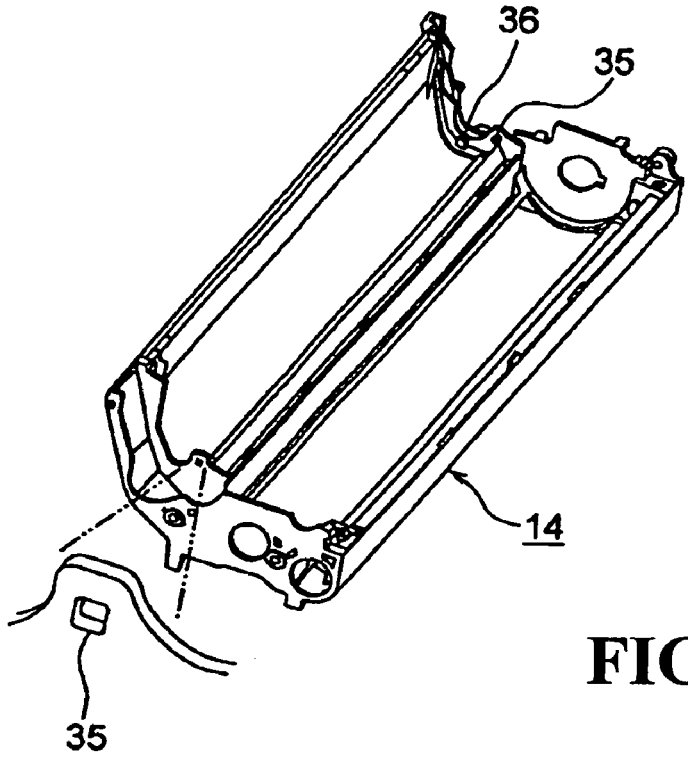
FIG. 13 is an exploded perspective view of the major portion of the developing device according to the first embodiment of the present invention.
Figure 14:
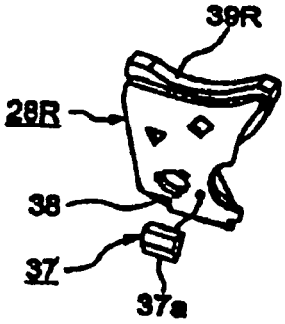
FIG. 14(*a*) is a perspective view of a sealing member and a sealing plate, FIG. 14(*b*) is an enlarged view of a protrusion on the sealing plate engaging a hole of a base frame when a roller assembly is installed in the base frame, and FIG. 14(*c*) is an enlarged view of a modified example of the protrusion shown in FIG. 14(*b*)
Figure 14:
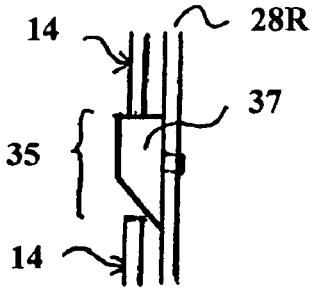
Figure 14:
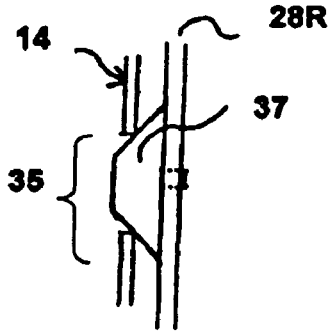

Still further, FIG. 13 is an exploded perspective view of the major portion of the developing device according to the first embodiment of the present invention. FIG. 14(*a*) is a perspective view of a sealing member and a sealing plate. FIG. 14(*b*) is an enlarged view of a protrusion 37 on a sealing plate 28R engaging a hole 35 of the base frame 14 when the supply roller assembly 31 is installed in the base frame 14. FIG. 14(*c*) is an enlarged view of a modified example of the protrusion 37 shown in FIG. 14(*b*).

As shown in FIG. 6, the supply roller assembly 31 comprises the supply roller 18; the stir bar 26; sealing members 39L and 39R disposed to contact with both ends of the supply roller 18 and the stir bar 26 for preventing toner from leaking through the both ends of the supply roller 18 and the stirring roller 26; and sealing plates or holding members 28L and 28R for holding the sealing members 39L and 39R.

As shown in FIG. 10, respective shafts of the supply roller 18 and the stir bar 26 pass through the sealing members 39L and 39R and the sealing plates 28L and 28R, and are held with the side frames 32L and 32R. A first sealing member is formed of the sealing members 39L and 39R, and a second sealing member is formed of the film 23. The sealing plate 28L and the sealing member 39L are arranged on a left side, and the sealing plate 28R and the sealing member 39R are arranged on a right side when viewed from an upstream side to a downstream side in a sheet conveyance direction.

As shown in FIG. 8, the sealing members 39L and 39R are respectively provided with side sponges or first sealing element 29 formed of a urethane foam and disposed to contact with end surfaces of the supply roller 18; and felt sponges or second sealing element 30 formed of a urethane foam and disposed to contact with an outer circumferential surface of the developing roller 16 at ends thereof.

The felt sponge 30 is attached onto a curved surface of the side sponge 29 via a double-sided adhesive tape, so as to slip under the film 23. The felt sponge 30 comprises a urethane foam section and a felt attached to the urethane foam section surface and having a surface contacting with the developing roller 16.

The film 23 extends to a position corresponding to the felt sponges 30 along a longitudinal direction of the supply roller assembly 31, and is adhered onto a slant adhering surface on the bottom surface of the base frame 14 via a double-sided adhesive tape.

As shown in FIG. 14(*a*), the protrusion 37 as an engaging section is attached onto each of the sealing plates 28L and 28R (only sealing plate 28R is shown in FIGS. 1 and 14) near a lower end of a surface thereof contacting with the base frame 14 so as to face a side of the base frame 14. An engaging section 38 with a recess is formed at a lower edge of each of the sealing plates 28L and 28R. A lower edge 37*a* of the protrusion 37 is beveled or rounded, so that the lower edge 37*a* forms a sliding surface.

As shown in FIGS. 1, 6, and 13, an indentation or hole 35 is formed in each of surfaces of the base frame 14 facing the side surfaces of the sealing plates 28L and 28R at a position corresponding to the protrusion 37 for engaging the same. As described above, the lower edge 37*a* of the protrusion 37 is beveled or rounded, so that the protrusion 37 can easily engage the hole 35. An upper edge of the protrusion 37 is perpendicular to the base frame for engaging the base frame upon being assembled. Accordingly, the supply roller assembly 31 does not come off the base frame easily.

As shown in FIG. 14(*c*), an upper edge of the protrusion 37 may be beveled or rounded as a modified example of the protrusion 37. In this case, it is possible to assemble accurately.

A protruding section 36 is formed on each of surfaces of the base frame 14 facing lower surfaces of the sealing plates 28L and 28R at a position corresponding to an engaging section 38.

The holes 35, the protruding sections 36, the engaging sections 38, and the protrusions 37 compose restricting sections for restricting movements of the sealing plates 28L and 28R and the sealing members 39L and 39R when the supply roller assembly 31 is attached to the base frame 14.

In the embodiment, the protrusions 37 and the engaging sections 38 are formed on the sealing plates 28L and 28R, and the holes 35 and the protruding sections 36 are formed on the base frame 14. Alternatively, the protrusions 37 may be formed in recess portions and the holes 35 in the base frame 14 may be replaced with protrusions. Further, the engaging sections 38 may be formed in protrusions, and the protruding sections 36 on the base frame 14 may be replaced with recess portions.

As shown in FIGS. 11 and 12, the photosensitive drum 12Bk and the charging roller 13 are supported at both ends thereof with the side frames 32L and 32R attached to the base frame 14 so as to be freely rotatable.

A process of assembling the developing device will be further described below.

First, as shown in FIGS. 6 and 7, the supply roller assembly 31 is placed on the base frame 14 with the film 23 attached thereto. At this moment, the supply roller assembly 31 is attached such that the felt sponges 30 attached to the sealing members 39L and 39R slip under the film 23.

As shown in FIG. 9, the photosensitive drum 12Bk is attached to the base frame 14, and the charging roller 13 is placed thereon so as to contact with the photosensitive drum 12Bk. Then, the developing roller 16 is placed between the photosensitive drum 12Bk and the supply roller 18 so as to contact with the photosensitive roller 12Bk and the supply roller 18. Accordingly, the film 23 is sandwiched between the developing roller 16 and the felt sponges 30 at the ends of the developing roller 16, thereby preventing toner from leaking.

As shown in FIG. 10, the side frames 32L and 32R having bearings of the respective rollers such as the photosensitive drum 12Bk, the charging roller 13, the developing roller 16, and the supply roller 18 are respectively attached to the base frame 14 from left and right sides thereof for positioning the respective rollers.

As shown in FIG. 11, the developing blade 17 is attached to the side frames 32L and 32R such that the developing blade 17 contacts with the developing roller 16 and the sealing members 39L and 39R. As a result, a closed storage section 20 surrounded by the base frame 14, the developing blade 17, the film 23, and the sealing members 39L and 39R is formed.

As shown in FIG. 12, the upper frame 15 is attached, and the toner cartridge 21 (FIG. 5) is attached to the opening 15*a* of the upper frame 15, thereby completing the operation of assembling the developing device 10Bk. A dented surface 34 is formed in the opening of the upper frame 15 at the upper end thereof for accommodating a lower end of the toner cartridge 21 therein, and an opening 34*a* corresponding to the opening 22 is formed in the dented surface 34.

As described above, when the supply roller assembly 31 is attached to the base frame 14, after the supply roller assembly 31 is attached to the base frame 14 while the felt sponges 30 attached to the sealing members 39L and 39R slip under the film 23, the photosensitive drum 12 is attached. Then, the charging roller 13 and the developing roller 16 are placed thereon, and the side frames 32R and 32L are attached from the left and right sides. The holes 35, the protruding sections 36, the engaging sections 35, and the protruding sections 36 compose the restricting sections for restricting movements of the sealing plates 28L and 28R and the sealing members 39L and 39R when the supply roller assembly 31 (the supply roller 18) is attached to the base frame 14.

It requires a delicate operation to insert the shafts of the rollers to the bearings of the side frames 32L and 32R. In a case that the restricting sections are not provided, when the shafts are repeatedly inserted, the supply roller assembly 31 may move forward/backward and/or upward/downward. When the supply roller assembly 31 moves, the felt sponges 30 may move onto the felt 23. Accordingly, the sealing of the film 23 becomes weak, so that the toner leaks from the both ends of the supply roller assembly 31 and drops onto the sheet, thereby generating dot stains on both edges of a printed surface.

In the embodiment, as described above, the protrusions 37 and the engaging sections 38 are formed on the sealing plates 28L and 28R, and the holes 35 and the protruding sections 36 are formed on the base frame 14. When the supply roller assembly 31 is attached to the base frame 14, the sliding surfaces 37*a* of the protrusion 37 slide along the side surfaces of the base frame 14 so as to lower the supply roller assembly 31. Then, the protruding sections 36 engage the engaging sections 38, and the holes 35 engage the protrusions 37 while making the felt sponges 30 not to move onto the film 23. Accordingly, the supply roller assembly 31 is attached to the base frame 14.

In this case, the protrusions 37 engage the holes 35 to restrict the upward/downward movement of the supply roller assembly 31, and the protruding sections 36 engage the engaging section 38 to restrict the forward/backward movement of the supply roller assembly 31. Therefore, when the side frames 32L and 32R are attached to the base frame 14, the supply roller assembly 31 does not move forward/backward and/or upward/downward, so that the felt sponges 30 do not move onto the film 23.

As a result, it is possible to improve sealing of the film 23, and prevent toner from leaking from the both ends of the supply roller assembly 31. Therefore, dot stains are not generated on both edges of a printed sheet, thereby improving image quality.

Second Embodiment

A second embodiment of the present invention will be described below. In the description below, elements in the second embodiment same as those in the first embodiment are designated by same reference numerals, and explanations thereof are omitted. The elements same as those in the first embodiment provide same effects.

Figure 15:
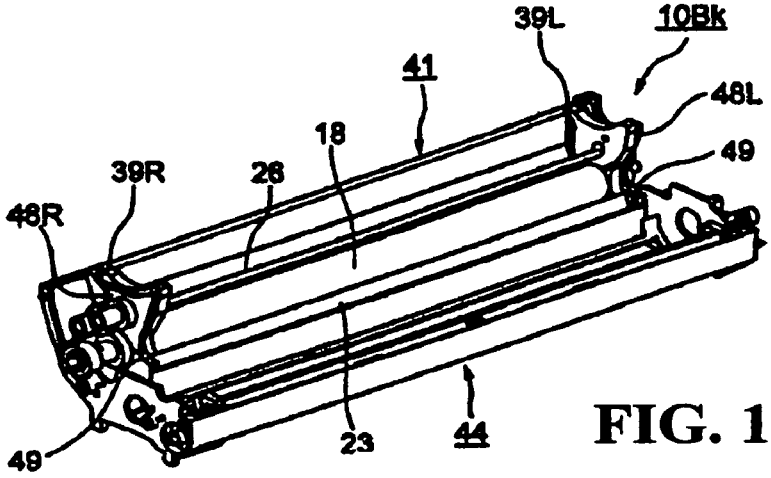
FIG. 15 is a perspective view of a major portion of a developing device according to a second embodiment of the present invention.
Figure 16:
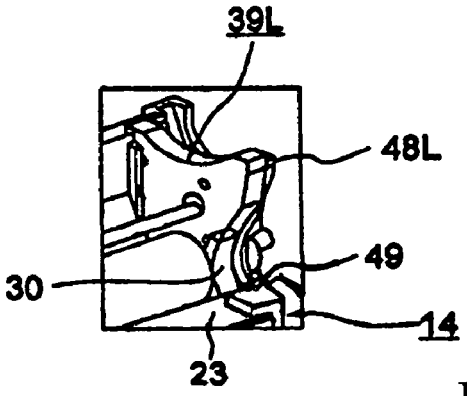
FIG. 16 is an enlarged view (No. 1) of the major portion of the developing device according to the second embodiment of the present invention.
Figure 17:
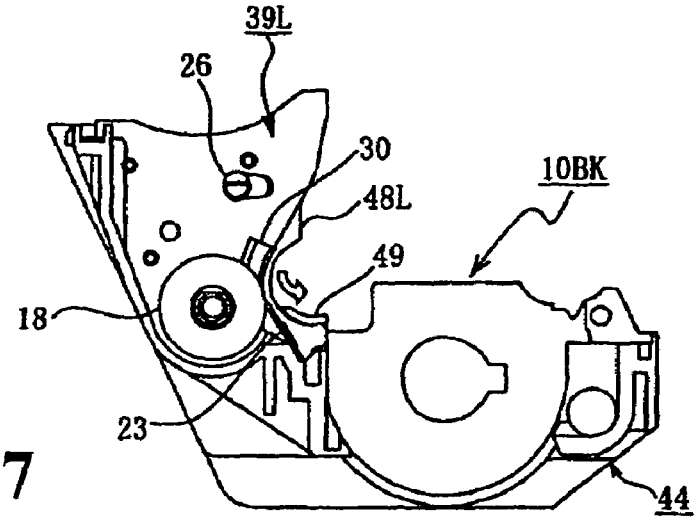
FIG. 17 is a side view of the major portion of the developing device according to the second embodiment of the present invention.
Figure 18:
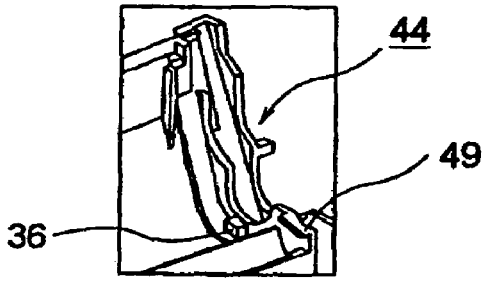
FIG. 18 is an enlarged view (No. 2) of the major portion of the developing device according to the second embodiment of the present invention.

FIG. 15 is a perspective view of a major portion of a developing device according to the second embodiment of the present invention. FIG. 16 is an enlarged view (No. 1) of the major portion of the developing device according to the second embodiment of the present invention. FIG. 17 is a side view of the major portion of the developing device according to the second embodiment of the present invention. FIG. 18 is an enlarged view (No. 2) of the major portion of the developing device according to the second embodiment of the present invention.

In the embodiment, ribs or restricting members 49 protruding inward are formed on upper edges of side surface of a base frame 44 (first case), so that the ribs 49 face upper surfaces of sealing plates 48L and 48R (holding members) above the end edges of the film 23 (second sealing member). In this case, the ribs 49 engage engaging portions of the sealing plates 48L and 48R at specific positions of the upper surfaces thereof.

The ribs 49 restrict movements of sealing members 39L and 39R (first sealing members) and the sealing plates 48L and 48R, when a supply roller assembly 41 (the supply roller 18 as the supply member) is attached to the base frame 44. When it is tried to attach the supply roller assembly 41 to the base frame 44 from above, lower edges of the sealing plates 48L and 48R contact with the ribs 49, so that the supply roller assembly 41 cannot be attached from above.

In the embodiment, when the supply roller assembly 41 is attached to the base frame 44, it is necessary to slide the supply roller assembly 41 along lower surfaces of the ribs 49 to rotate in an arrow direction in FIG. 17. When the supply roller assembly 41 is rotated, the sponges 30 slip under the film 23, thereby making it possible to correctly attach the supply roller assembly 41.

In addition, the ribs 49 restrict the upward/downward movement of the supply roller assembly 41. Accordingly, when the side frames 32L and 32R are assembled, the supply roller assembly 41 does not move upward/downward and the respective sponges 30 do not move onto the film 23.

As a result, it is possible to improve sealing of the film 23, and prevent toner from leaking from both ends of the supply roller assembly 31. Therefore, dot stains are not generated on both edges of a printed sheet, thereby improving image quality.

Third Embodiment

A third embodiment of the present invention will now be described below. In the description below, elements in the third embodiment same as those in the first embodiment are designated by same reference numerals, and explanations thereof are omitted. The elements same as those in the first embodiment provide same effects.

Figure 19:
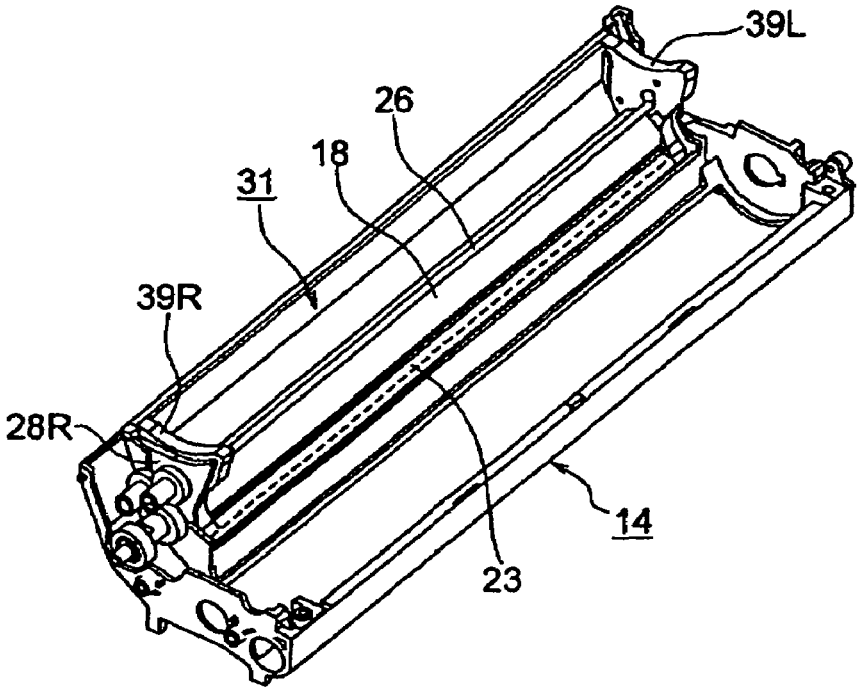
FIG. 19 is a perspective view of a major portion of a developing device according to a third embodiment of the present invention.
Figure 20:
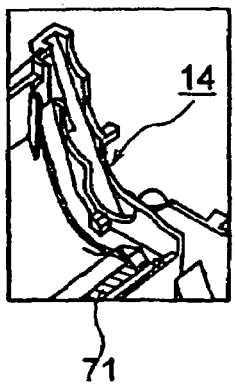
FIG. 20 is an enlarged view (No. 1) of the major portion of the developing device according to the third embodiment of the present invention.
Figure 21:
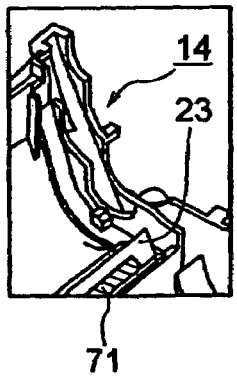
FIG. 21 is an enlarged view (No. 2) of the major portion of the developing device according to the third embodiment of the present invention.
Figure 22:
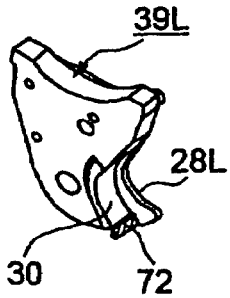
FIG. 22 is a perspective view of a sealing member and a sealing plate according to the third embodiment of the present invention.
Figure 23:
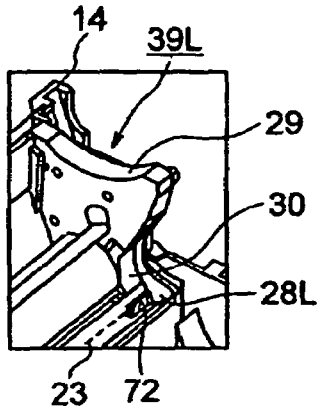
FIG. 23 is an enlarged view (No. 3) of the major portion of the developing device according to the third embodiment of the present invention.

FIG. 19 is a perspective view of a major portion of a developing device according to the third embodiment of the present invention. FIG. 20 is an enlarged view (No. 1) of the major portion of the developing device according to the third embodiment of the present invention. FIG. 21 is an enlarged view (No. 2) of the major portion of the developing device according to the third embodiment of the present invention. FIG. 22 is a perspective view of a sealing member and a sealing plate according to the third embodiment of the present invention. FIG. 23 is an enlarged view (No. 3) of the major portion of the developing device according to the third embodiment of the present invention.

In the figures, reference numeral 14 designates the base frame as the first case, and 39L and 39R are the sealing members as the first sealing members. The sealing members 39L and 39R are held by the sealing plates 28L and 28R as the holding members.

As shown in FIG. 20, a sticking surface or first sticking section 71 is formed on the base frame 14, and extends close to positions of the sealing members 39L and 39R at both ends of the base frame 14 in a longitudinal direction thereof where the felt sponges 30 are inserted, so that the film 23 is attached to the sticking surface 71. The sticking surface 71 may be formed of, for example, a double-sided tape.

The film 23 has a length ranging between the positions of the sealing members 39L and 39R where the respective felt sponges 30 are inserted. As shown in FIG. 21, the film 23 is stuck onto the sticking surface 71 along the longitudinal direction. Accordingly, the film 23 is not stuck onto the sticking surface 71 at the both ends thereof by a width of the felt sponges 30.

The sealing members 39L and 39R have sticking surfaces or second sticking sections 72 at lower portions of the felt sponges 30. The sticking surfaces 72 are situated at a height same as that of the sticking surface 71, and are formed so as to cover a whole width of the felt sponges 30. In the embodiment, a restricting section for restricting movements of the sealing plate 28L and 28R is formed of the both edges of the film 23 and the sticking surfaces 72. The sticking surfaces 72 may be formed of, for example, a double-sided tape.

Accordingly, in a process of attaching the supply roller assembly 31 into the base frame 14, when the supply roller assembly 31 is attached to the base frame 14 while the felt sponges 30 slip under the film 23 at the both edges of the supply roller assembly 31, the both edges of the film 23 contact with the sticking surfaces 72, so that the film 23 is adhered and secured to the sealing members 39L and 39R.

Accordingly, when the side frames 32L and 32R are assembled, the supply roller assembly 31 does not move upward/downward, and the respective felt sponges 30 do not move onto the film 23. Therefore, it is possible to prevent toner from leaking at the both edges of the supply roller assembly 30.

Fourth embodiment

A fourth embodiment of the present invention will now be described below. In the description below, elements in the fourth embodiment same as those in the first embodiment are designated by same reference numerals, and explanations thereof are omitted. The elements same as those in the first embodiment provide same effects.

Figure 24:
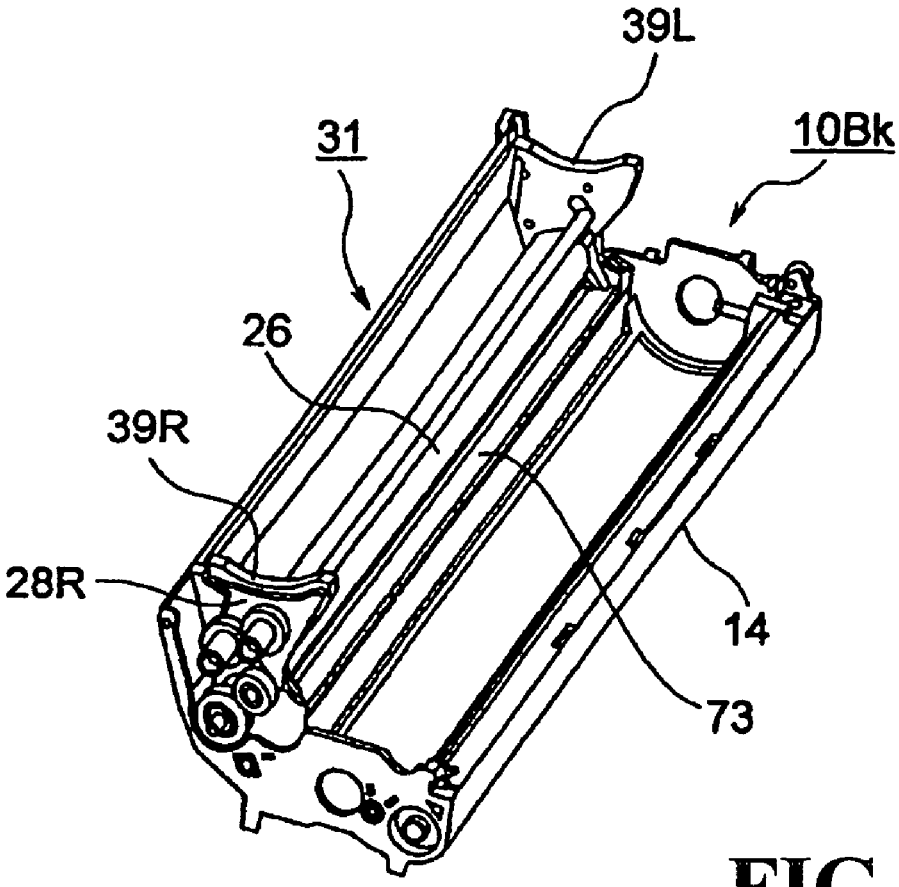
FIG. 24 is a perspective view of a major portion of a developing device according to a fourth embodiment of the present invention.
Figure 25:
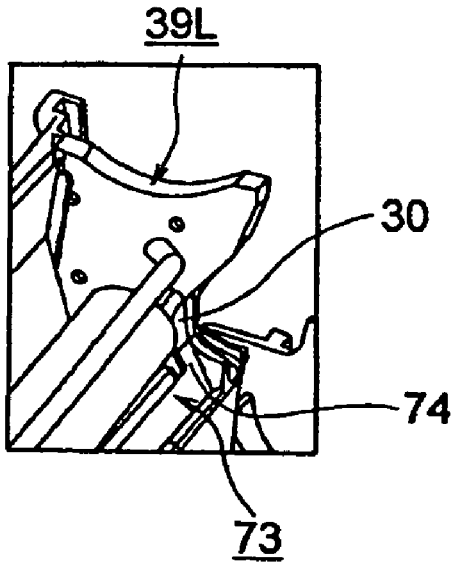
FIG. 25 is an enlarged view of a major portion of the developing device according to the fourth embodiment of the present invention.

FIG. 24 is a perspective view of a major portion of a developing device according to the fourth embodiment of the present invention. FIG. 25 is an enlarged view of a major portion of the developing device according to the fourth embodiment of the present invention.

In the embodiment, a film 73 as a second sealing member has extending sections 74 at both ends in a longitudinal direction thereof at positions of the felt sponges or second sealing elements 30 at the both ends of the supply roller assembly 31. The extending sections 74 have a width same as that of the felt sponges 30 and extend along a rotating direction (upward direction in FIGS. 24 and 25) of the developing roller or developer supporting member 16. A restricting section for restricting movements of the sealing plates 28L and 28R, i.e., the holding members, is formed of the extending sections 74.

In the embodiment, in the process of attaching the supply roller assembly 31 to the base frame 14, i.e., the first case, in the developing device 10Bk, the felt sponges 30 at the both edges of the supply roller assembly 31 slip under the extending sections 74, thereby completing the assembly of the supply roller assembly 31.

In the embodiment, the felt sponges 30 are attached to the sealing plate 28L and 28R over a large area, and the sealing plate 28L and 28R urge the supply roller assembly 31 with a large force. Accordingly, when the side frames 32L and 32R are assembled, the supply roller assembly 31 does not move upward/downward, and the felt sponges 30 do not move onto the film 73. Therefore, it is possible to prevent toner from leaking at the both edges of the supply roller assembly 30.

In the embodiments described above, the color printer among image forming apparatus is described. The present invention is applicable to other image forming apparatus including a mono-color printer, a copy machine, a facsimile machine, and a multifunctional device.

The disclosure of Japanese Patent Application No. 2005-289081, filed on Sep. 30, 2005, is incorporated in the application.

While the invention has been explained with reference to the specific embodiments of the invention, the explanation is illustrative and the invention is limited only by the appended claims.

What is claimed is:

1. A developing device comprising:

an image supporting member for forming a latent image on a surface thereof;

a developer supporting member for attaching developer to the latent image;

a supply member for supplying developer to the developer supporting member;

a first sealing member arranged at both ends of the developer supporting member and the supply member;

a holding member for holding the first sealing member;

a case for attaching the developer supporting member and the supply member;

a second sealing member arranged in the case for contacting with a lower surface of the developer supporting member along a longitudinal direction thereof; and a restricting section for restricting a movement of the holding member, said restricting section being arranged to extend inward inside the case to prevent the supply member from being attached from the above in a vertical direction.

2. The developing device according to claim 1, wherein said restricting section is disposed on a surface facing the holding member.

3. The developing device according to claim 1, wherein said restricting section is arranged to face a lower surface of the holding member.

4. An image forming apparatus comprising the developing device according to claim 1.

5. The developing device according to claim 1, wherein said restricting section is arranged to face an upper surface of the holding member.

6. A developing device comprising:

an image supporting member for forming a latent image on a surface thereof;

a developer supporting member for attaching developer to the latent image;

a supply member for supplying developer to the developer supporting member;

a first sealing member arranged at both ends of the developer supporting member and the supply member;

a holding member for holding the first sealing member;

a case for attaching the developer supporting member and the supply member; a second sealing member arranged in the case for contacting with a lower surface of the developer supporting member along a longitudinal direction thereof; and a restricting section for restricting a movement of the of the holding member, wherein said holding member includes an engaging section for engaging the restricting section.

7. The developing device according to claim 6, wherein one of said restricting section and said engaging section is formed of a protruding portion, and the other of said restricting section and said engaging section is formed of a recess portion.

8. The developing device according to claim 7, wherein said protruding portion includes a surface inclined relative to a direction facing the recess portion.

9. The developing device according to claim 6, wherein said restricting section is on surface facing the holding member.

10. The developing device according to claim 6, wherein said restricting section is arranged to face a lower surface of the holding member.

11. The developing device according to claim 6, wherein said holding portion includes a plurality of engaging sections for engaging a plurality of restricting sections.

12. A developing device comprising:

an image supporting member for forming a latent image on a surface thereof;

a developer supporting member for attaching developer to the latent image;

a supply member for supplying developer to the developer supporting member;

a first sealing member arranged at both ends of the developer supporting member and the supply member, said first sealing member having a sticking portion formed of an adhesive portion;

a holding member for holding the first sealing member;

a case for attaching the developer supporting member and the supply member; and a second sealing member arranged in the case for contacting with a lower surface of the developer supporting member along a longitudinal direction thereof, said second sealing member having an end portion attached to the sticking portion.

13. An image forming apparatus comprising the developing device according to claim 12.

14. The developing device according to claim 12, wherein said sticking portion is formed of double-sided tape.

15. A developing device comprising:

an image supporting member for forming a latent image on a surface thereof;

a developer supporting member for attaching developer to the latent image;

a supply member for supplying developer to the developer supporting member;

a first sealing member arranged at both ends of the developer supporting member and the supply member;

a holding member for holding the first sealing member;

a case for attaching the developer supporting member and the supply member; and a second sealing member arranged in the case for contacting with a lower surface of the developer supporting member along a longitudinal direction thereof, said second sealing member having an end portion extending along the first sealing member in a direction perpendicular to the longitudinal direction.

16. An image forming apparatus comprising the developing device according to claim 15.

17. The developing device according to claim 15, wherein said end portion has a width substantially same as that of the sealing member.

18. The developing device according to claim 15, wherein said end portion extends in a direction that the image supporting member rotates.

* * * * *